US009198259B2

(12) United States Patent
Hoang

(10) Patent No.: US 9,198,259 B2
(45) Date of Patent: Nov. 24, 2015

(54) PROGRAMMABLE TOUCHSCREEN DIMMER WITH INTERCHANGEABLE ELECTRONIC FACEPLATE

(71) Applicant: Nguyen Hoan Hoang, Brossard (CA)

(72) Inventor: Nguyen Hoan Hoang, Brossard (CA)

( * ) Notice: Subject to any disclaimer, the term of this patent is extended or adjusted under 35 U.S.C. 154(b) by 159 days.

(21) Appl. No.: 14/189,405

(22) Filed: Feb. 25, 2014

(65) Prior Publication Data

US 2014/0239843 A1 Aug. 28, 2014

Related U.S. Application Data

(60) Provisional application No. 61/770,109, filed on Feb. 27, 2013.

(51) Int. Cl.
*H05B 37/02* (2006.01)
*H05B 33/08* (2006.01)

(52) U.S. Cl.
CPC ..... *H05B 37/02* (2013.01); *H05B 33/0845* (2013.01)

(58) Field of Classification Search
USPC ..... 315/291–311
See application file for complete search history.

(56) References Cited

U.S. PATENT DOCUMENTS 5,248,919 A * 9/1993 Hanna ..... H05B 39/086 315/291
7,271,550 B2 9/2007 Vanderzon
7,663,325 B2 2/2010 McDonough et al.
7,791,595 B2 9/2010 Altonen et al.
8,098,029 B2 1/2012 Newman, Jr. et al.
8,274,233 B2 * 9/2012 Altonen ..... H05B 37/02 315/131
8,296,669 B2 10/2012 Madonna et al.
2010/0308738 A1 * 12/2010 Shteynberg ..... H05B 33/0812 315/185 R
2011/0162946 A1 * 7/2011 Altonen ..... H05B 37/02 200/33 R
2012/0230073 A1 9/2012 Newman, Jr. et al.
2013/0026947 A1 * 1/2013 Economy ..... H05B 37/0272 315/287
2013/0249431 A1 * 9/2013 Shteynberg ..... H05B 37/02 315/287
2015/0178975 A1 * 6/2015 Chatterjee ..... G06T 15/04 345/587

* cited by examiner

*Primary Examiner* — Brandon S Cole
(74) *Attorney, Agent, or Firm* — Daniel Boudwin; Global Intellecutal Property Agency

(57) ABSTRACT

A programmable touchscreen light source dimmer is provided. The present invention comprises a dimmer circuitry housing that fits within a conventional light switch box, a removable faceplate, and optionally a cover that may be affixed over the faceplate. The present invention uses a microcontroller that is able to alter the output signal that is used to control the luminosity of the connected light sources between PWM and reverse phase control so that the type of dimming is ideally suited for the type of light source. The faceplate has a dynamic touchscreen through which users can easily alter the luminosity of connected light sources, program that device to follow preset schedules or respond to external stimuli, or activate various secondary functions.

12 Claims, 3 Drawing Sheets

PROGRAMMABLE TOUCHSCREEN DIMMER WITH INTERCHANGEABLE ELECTRONIC FACEPLATE

CROSS REFERENCE TO RELATED APPLICATION

This application claims the benefit of U.S. Provisional Application No. 61/770,109 filed on Feb. 27, 2013 entitled "Smart Light Dimmer Switch." The above identified patent application is herein incorporated by reference in its entirety to provide continuity of disclosure.

BACKGROUND OF THE INVENTION

1. Field of the Invention

The present invention relates to light fixture control devices. More specifically, the present invention relates to light fixture dimmer control units that are programmable and remotely accessible.

Light dimmers are a generally simple electrical appliance that have changed little over time. Although they may perform their main purpose adequately, conventional light dimmers offer limited additional functionality and only utilize a single method for controlling the luminosity of the connected light sources. Current light dimmers fail to utilize advances in technology to provide additional features to users, increasing their functionality and improving the efficiency of their power consumption.

Electrical devices designed to control the amount of RMS voltage received by a light source are well known in the prior art. Several different types of technologies are used for dimming light sources, including PWM, reverse phase control, and forward phase control, among others. Several different devices are known in the prior art that utilize these various technologies, however none of these devices offer a device that is capable of selectively and alternately utilizing multiple types of these different RMS control technologies. Because different light dimming devices utilize only a single type of method to reduce the amount of voltage received by the light source, these types of dimmers will always be ideally suited for specific types of light sources and may not be as efficient with other types of light sources. Devices having touchscreens that are able to control the amount of power driven to a load are also well known in the prior art, however these devices generally require physical actuation by the user and cannot simultaneously be used wirelessly.

The present programmable touchscreen dimmer provides a dimmer that can utilize multiple different methods for reducing the RMS voltage provided to the connected light source. The present invention comprises a microcontroller that can reversibly switch between PWM dimming and reverse phase control dimming, depending on which is more efficient, based upon the type of light source. Furthermore, the present invention can be installed within a conventional electrical light switch box, allowing it to be retrofitted into any home. The touchscreen of the present invention provides an intuitive user interface that can be used to control the luminosity of the light sources connected to the present invention and also program the device to respond to both internal and external variables, as dictated by the user.

2. Description of the Prior Art

Devices have been disclosed in the prior art that relate to dimmer circuit arrangements and programmable dimmers. These include devices that have been patented and published in patent application publications. These devices generally relate to circuit arrangements for reducing the power draw by light sources. The following is a list of devices deemed most relevant to the present disclosure, which are herein described for the purposes of highlighting and differentiating the unique aspects of the present invention, and further highlighting the drawbacks existing in the prior art.

One such device is U.S. Pat. No. 7,271,550 to Vanderzon, which describes a dimmer circuit that uses an IGBT to control the delivery of power to a load. The present invention also preferably utilizes an IGBT and PWM dimming technology, however the microcontroller can also optionally switch to reverse phase dimming.

Another such device is U.S. Pat. No. 7,663,325 to McDonough, which describes a programmable wallbox dimmer having an intensity selector and a menu that allows users to access a variety of programmable features. The present invention also has a variety of programmable features and an intensity selector, however it further utilizes PWM to reduce the power consumption of the controlled light fixtures and supports wireless connectivity to electronic devices.

U.S. Pat. No. 7,791,595 to Altonen and U.S. Pat. No. 8,098,029 to Newman, Jr. disclose devices for controlling the amount of power delivered to an electrical load and having a touch screen user interface. Altonen and Newman, Jr. both comprise a touch-sensitive faceplate that is able to transmit the actuation from a user to the underlying electrical circuitry, which in turn controls a connected electrical load. The present invention also utilizes a touchscreen user interface to allow users to control the luminosity, i.e. the load, of a light fixture, however it also comprises a means for providing wireless connectivity to other electronic devices and the faceplate portion of the present invention is interchangeable.

Another such device is U.S. Pat. No. 8,296,669 to Madonna, which discloses a programmable multimedia controller that is configured to control various devices within a home and a display screen that provides a user interface based on a virtual representation of a room. The display of the present invention is a simple sliding bar that can be actuated to control the brightness of the light fixtures connected thereto. The display of the present invention can also be configured to show a simple picture when not in use, but the display is not based upon a virtual representation of a room.

Finally, U.S. Patent Application Publication No. 2012/0230073 to Newman, Jr. describes a two wire load control device, for applications such as a dimmer switch, for controlling the amount of power delivered from an AC power source to an electrical load, such as an LED light. Newman, Jr. utilizes a method of PWM called phase cutting, rather than traditional forward phase control or reverse phase control methods. The present invention also utilizes a PWM technique for reducing the amount of power consumption of the device, however the present invention also includes a programmable control unit that can be wirelessly controlled by other electronic devices.

The present programmable touchscreen dimmer comprises a control housing that fits within a standard electrical light switch box and a removable faceplate that can be attached thereto. The faceplate has touchscreen controls and may be programmed to serve additional purposes when not in use, such as a night light or as a digital picture display. The control housing utilizes a PWM technique for minimizing the power draw by the light fixtures to which it is connected and can be configured to be wirelessly accessible by other electronic devices, such as laptops or smartphones. It substantially diverges in design elements from the prior art and consequently it is clear that there is a need in the art for an improvement to existing programmable dimmer devices. In this regard the instant invention substantially fulfills these needs.

SUMMARY OF THE INVENTION

In view of the foregoing disadvantages inherent in the known types of programmable dimmers now present in the prior art, the present invention provides a new programmable dimmer wherein the same can be utilized for providing convenience for the user when controlling the brightness of light fixtures in his or her home.

It is therefore an object of the present invention to provide a new and improved programmable dimmer device that has all of the advantages of the prior art and none of the disadvantages.

It is another object of the present invention to provide a programmable dimmer device that allows users to quickly and intuitively adjust the brightness of light fixtures connected to the present invention.

Another object of the present invention is to provide a programmable dimmer device that minimizes the amount of electricity used by the light fixtures connected to the present invention.

Yet another object of the present invention is to provide a programmable dimmer device that can be configured to respond to a schedule, interact with motion sensors, or otherwise vary the brightness of the connected light fixtures based on external variables.

Yet another object of the present invention is to provide a programmable dimmer that has secondary uses when not being actively utilized by a user.

Still yet another object of the present invention is to provide a programmable dimmer that can be wirelessly controlled by other electronic devices.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
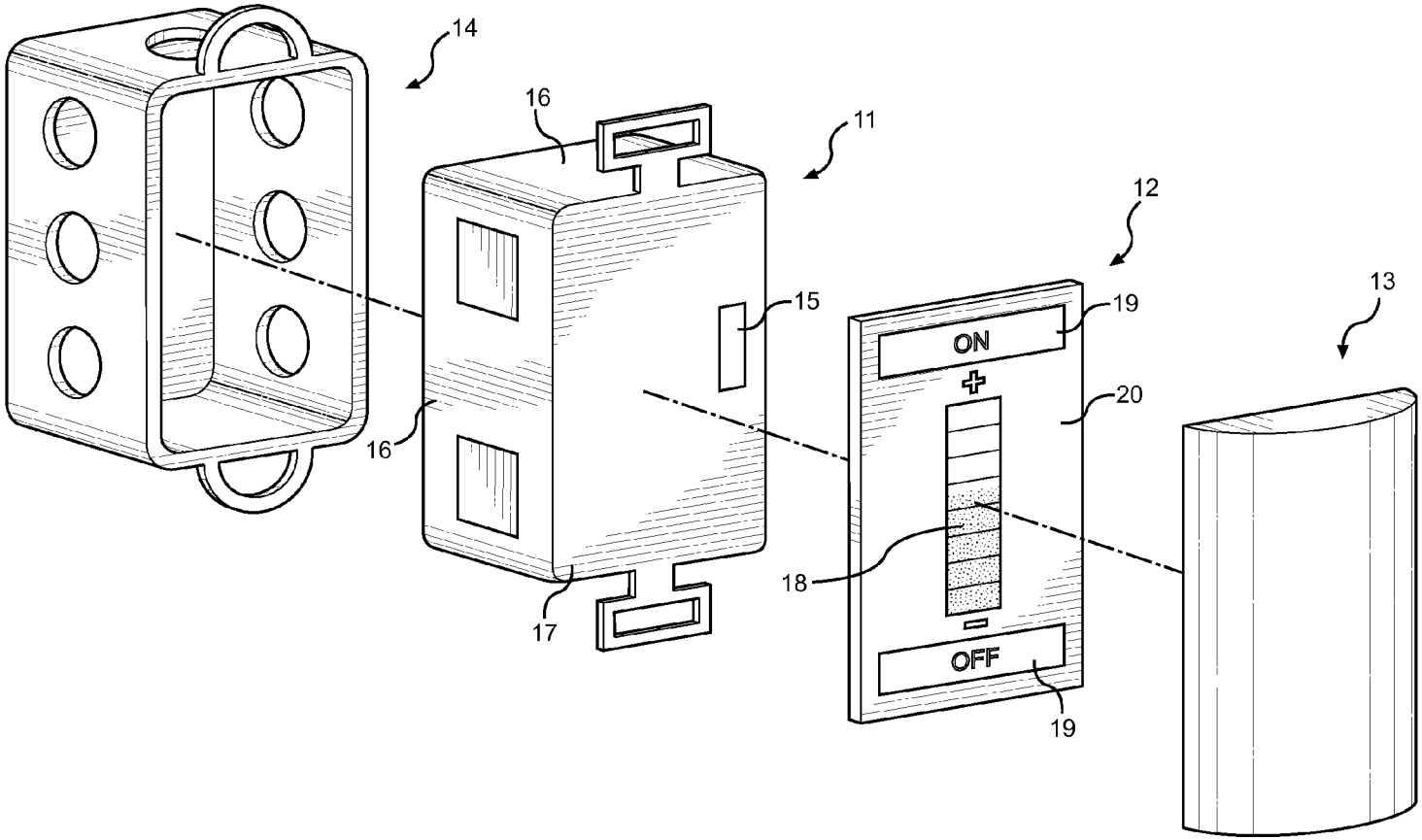
FIG. 1 shows an exploded view of the present invention.

Reference is made herein to the attached drawings. Like reference numerals are used throughout the drawings to depict like or similar elements of the programmable touchscreen dimmer. For the purposes of presenting a brief and clear description of the present invention, the preferred embodiment will be discussed as used for controlling the luminosity of light fixtures and performing other secondary functions in a user's home. The figures are intended for representative purposes only and should not be considered to be limiting in any respect.

Referring now to FIG. 1, there is shown an exploded view of the present invention. The present invention comprises a dimmer circuitry housing 11, which fits into a conventional electrical light switch box 14, a touchscreen faceplate 12 that mounts onto the exterior of the dimmer circuitry housing 11, and optionally a cover 13 that removably attaches to the exterior face of the touchscreen faceplate 12. The present invention is designed to replace conventional light switches or dimmers, and therefore fits within a conventional electrical light switch box, allowing the device to be easily integrated into existing homes and new construction without any issues. The present invention is a programmable dimmer for light fixtures connected thereto, which has additional secondary features and a convenient user interface.

The dimmer circuitry housing 11 comprises a plurality of sidewalls 16 and a front face 17 containing the dimming subsystem, which comprises the circuitry and microcontroller that controls the dimming of the attached light fixtures. The dimmer circuitry housing 11 is designed to fit into a conventional light switch box 14. The front face 17 is substantially flat and has a control interface 15 disposed thereon. The control interface 15 is any type of conventional electrical connector that is known in the prior art. Light fixtures are connected to the present invention just as with a conventional dimmer, i.e. neutral, hot, and ground wires are attached to the rear side of the dimmer circuitry housing 11. The microcontroller in the dimming subsystem alternately uses pulse-width modulation (PWM) or reverse phase control to control the dimming of the attached light fixture or fixtures, depending upon which form of dimming control is more efficient for the type of attached light fixture.

The dimming subsystem microcontroller utilizes an IGBT to switch between PWM and reverse phase dimming control. PWM dimming operates by rapidly switching the connected light source on and off, faster than the human eye can register. Because the light fixture is only powered intermittently, the amount of power consumed by the connected light fixture is reduced because the light fixture is not drawing power continuously. The microcontroller varies the duty cycle of its pulses, thereby altering the apparent brightness of the attached light source. As long as the pulse rate is high enough, the human eye cannot register the on and off flickering of the light and instead merely perceives an overall average luminosity, which is dictated by the duty cycle of the pulse. PWM is ideally suited to be used with LED lights because, unlike many other forms of LED light dimming, it does not affect the color of the LED light. Reverse phase control dimming is a type of AC phase control and was originally designed for use with incandescent lighting, rather than LED lighting. Reverse phase control dimming works by cutting off the trailing edge of the AC signal, thereby reducing the average power from the AC input, which dims the light because the brightness of the light is proportional to the average power of the signal. The microcontroller's ability to switch between these two types of dimming control allows the present invention to alter its output depending upon the type of connected light source. In some embodiments of the present invention, the user programs the present invention to output a certain type of signal, whereas in other embodiments the microcontroller automatically tests, determines, and then utilizes the ideal type of dimming control based on the type of connected light source.

The faceplate 12 has a touchscreen 20 with a luminosity control 18 and a plurality of buttons 19 disposed thereon, a back face that is capable of removably engaging with the control interface 15, and a wireless connectivity subsystem. The touchscreen 20 is any type of conventional touchscreen, such as an LCD touchscreen. The design of the touchscreen 20, as depicted, is merely exemplary and no claim is made as to the precise orientation or appearance of the touchscreen controls. The luminosity control 18 allows users to control the brightness of light sources connected to the present invention in an intuitive and convenient manner. The touchscreen 20 is responsive to force and position actuation by the user and translates that actuation into commands to the various subsystems of the present invention, include reducing or increasing the luminosity of connected light sources. Thus, when the user actuates the luminosity control 18 depicted on the touchscreen 20, the faceplate 12 subsystem translates that input into a corresponding signal that travels through the control interface 15 to alter the output of the dimming subsystem contained within the dimmer circuitry housing 11. The faceplate 12 may have additional command buttons 19 disposed across the touchscreen 20 that either turn connected lights on and off, rather than merely dimming them, or activating various secondary functions of the present invention.

The faceplate 12 is freely interchangeable with other faceplates 12 having different shapes and designs so that a user can more easily match the present invention to the surrounding room. The faceplate 12 is preferably connected to the dimmer circuitry housing 11 unit via the control interface 15, which holds the back surface of the faceplate 12 flush against the dimmer circuitry housing 11, in addition to acting as an electrical and data connection. Alternatively, additional attachment means that allow the faceplate 12 to be freely interchanged may be utilized, including tabs disposed along the exterior of the dimmer circuitry housing 11 that reversibly engage with complimentary portions on the faceplate 12, magnets, and other similar methods of removable attachment. Furthermore, no claim is made as to the precise size of the present invention. In its simplest form, as depicted in FIG. 1, the present invention may comprise a simple luminosity control 18 and a pair of on and off buttons 19. However, the present invention is capable of supporting a wide variety of additional features, including programmable dimmer functions and secondary non-dimmer functions, such as displaying images or serving as a night light. The faceplate 12 may be larger to accommodate an increased number of buttons, or may be the size of a conventional light switch faceplate.

The present invention may be programmed to automatically alter the luminosity of connected light sources based on either programmed user input or exterior variables. Users enter the conditions that they wish the present invention to respond to using the control user interface displayed on the touchscreen 20. Users can either set a schedule that they would like the present invention to adhere to, such as to automatically dim the lights between the hours of 11 PM and 6 AM, and the present invention will automatically keep time using an included time mechanism and respond appropriately to the user input. Users can also program the present invention to respond in certain ways based upon external variables. For example, the present invention can be interfaced with motion sensors contained around the house and the programmed to automatically dim or turn off the lights if no motion is detected around the house after a preset period of time.

The control user interface to program the present invention or to control the secondary functions of the present invention can be displayed on the screen in a number of different ways. In one embodiment of the present invention, the control user interface and the luminosity control means are displayed persistently and simultaneously. In another embodiment, the control user interface fades out when not in use and instead the touchscreen 20 only displays the luminosity control 18. The various programmable functions, luminosity controls, and various other buttons may be displayed in any matter and therefore no claim is made as to the exact configuration of the various components displayed by the touchscreen 20.

The faceplate 12 is removably attached and may be freely interchanged with other faceplates 12 offering users differently functionality. Various embodiments of the faceplate 12 can have motion sensors, can function as a nigh light when not in use, and perform various other functions. The faceplate 12 component of the present invention comprises its own microcontroller, separate from the microcontroller and various other subsystems contained within the dimmer circuitry housing 11. The microcontroller of the faceplate 12 controls the faceplate's 12 various subsystems, such as the wireless connection subsystem, the motion sensor subsystem, and the subsystem controlling the output displayed thereon. The wireless connection allows users to wirelessly connect to and program the present invention via a wireless connection, such as WiFi or Bluetooth, as is submitted is commonly known in the prior art. In an alternative embodiment of the present invention, multiple light fixtures can be connected to the present programmable touchscreen dimmer, allowing users to control every light in their house via a single user interface, whether wirelessly or by using the touchscreen itself.

In an alternative embodiment of the present invention, the control interface 15 may be designed to removably engage with a conventional tablet or other mobile device running an operating system such as Android, as it is submitted is well known in the prior art. In this embodiment of the present invention, when users affix their portable electronic device, such as an Android tablet, to the exposed portion of the dimmer circuitry housing 11 via the control interface 15, the microcontroller and various subsystems contained within the dimmer circuitry housing 11 automatically detect the presence of the portable electronic device and send a signal to that device to load the user interface. Once the user interface is loaded, the user can then alter the luminosity of the lights fixtures attached connected to the present invention, program the device to follow a programmed schedule, and control the various other functions of the present invention as herein described. The user can then disconnect his or her portable electronic device from the control interface 15 and the present invention will store those commands in a memory unit contained within the dimmer circuitry housing 11 and undertake the user-provided commands as programmed without further input from the user. Alternatively, the user may program these functions via a wireless connection, such as WiFi or Bluetooth, as shown in FIG. 3.

Figure 2:
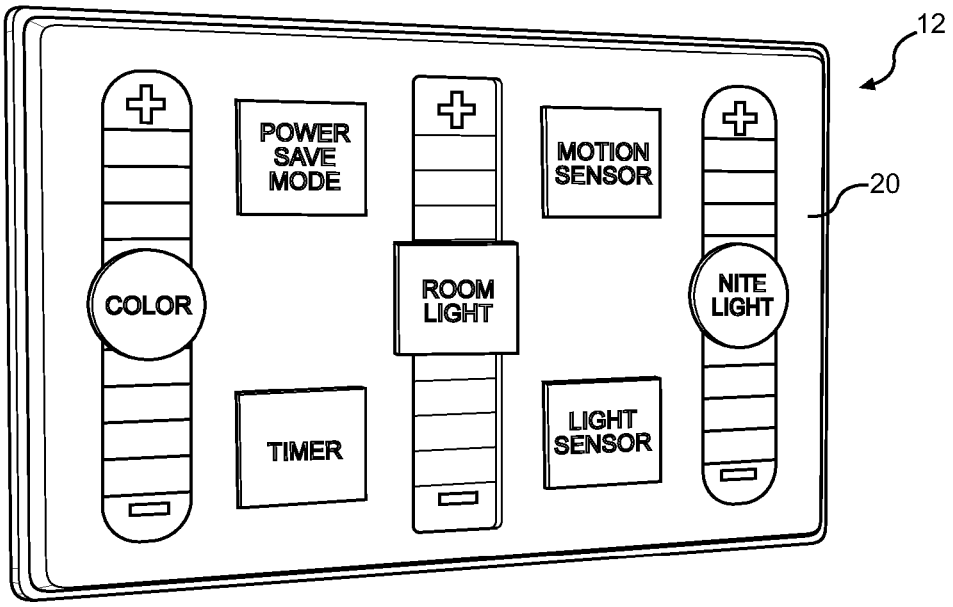
FIG. 2 shows a perspective view of an alternate embodiment of the faceplate component of the present invention.

Referring now to FIG. 2, there is shown a perspective view of an alternate embodiment of the faceplate component of the present invention. The display on the faceplate 12 can have a different size, configuration, and number of inputs depending upon the variety of functions of the particular embodiment of the present invention. The present invention can have sliding bars that can be actuated by the user, direct alphanumeric inputs, buttons and menus that allow the user to choose from a set list of items, and other types of inputs that allow the user to control the various aspects of the present invention via the user interface. The present user interface is also preferably dynamic and able to switch inputs that are made available to the user based upon prior inputs or other variables.

In an embodiment of the present invention, when not being utilized by the user, the present user interface preferably defaults to an image pre-loaded onto the device by a user after a set period of time. The present invention may further include a memory unit for storing images and other user uploads. The user can therefore pre-load an image, such as a photograph, onto the device so that when the present invention is not in use it appears to be a framed picture and thereby better blend into the surrounding room. In an alternative embodiment, the display of the present invention may not automatically shift to display the user-loaded image and may instead require that the user input a command in order to shift the display to the user-loaded image.

Figure 3:
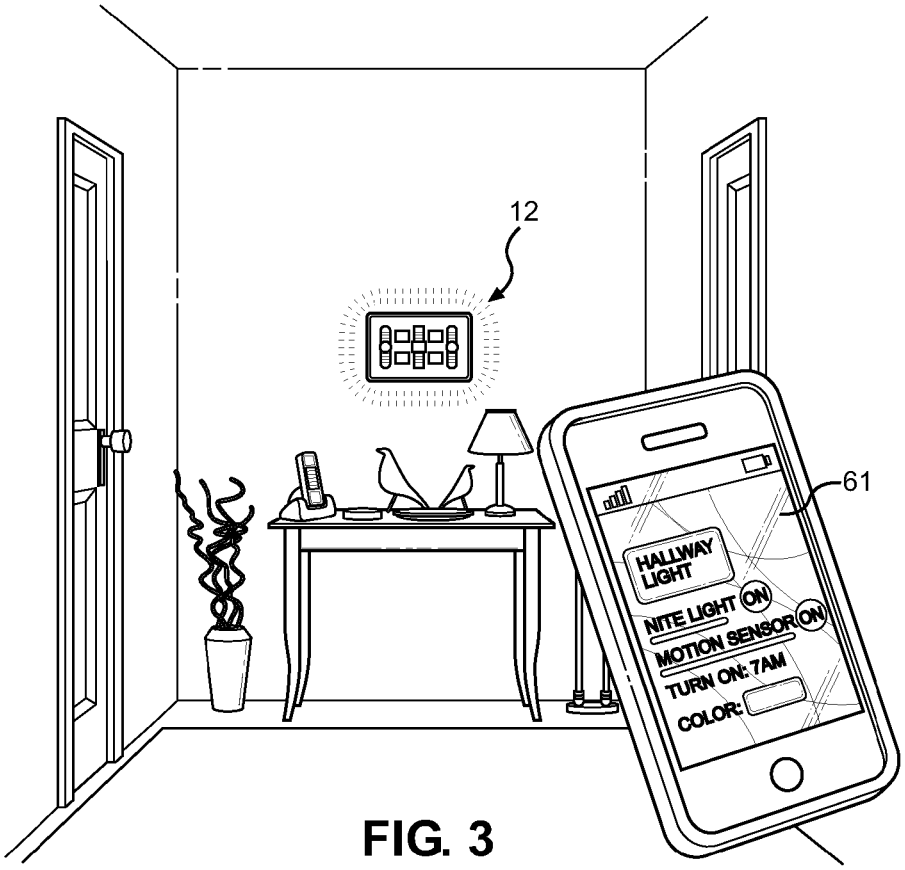
FIG. 3 shows a perspective view of an electronic device remotely controlling the present invention.

Referring now to FIG. 3, there is shown a perspective view of an electronic device remotely controlling the present invention. The present invention is wirelessly controllable by an electronic device 61, such as a smartphone or a laptop computer. The wireless control of the present invention can be via a Bluetooth connection or over the user's home or business wireless network. The electronic device 61 can download an application that allows users to control the present invention and offers its own user interface to accept and effectuate the user's commands. The electronic device 61 communicates with the present invention via a subsystem contained within the present invention's faceplate or dimmer circuitry housing, which is adapted to receive and process such wireless signals.

Figure 4:
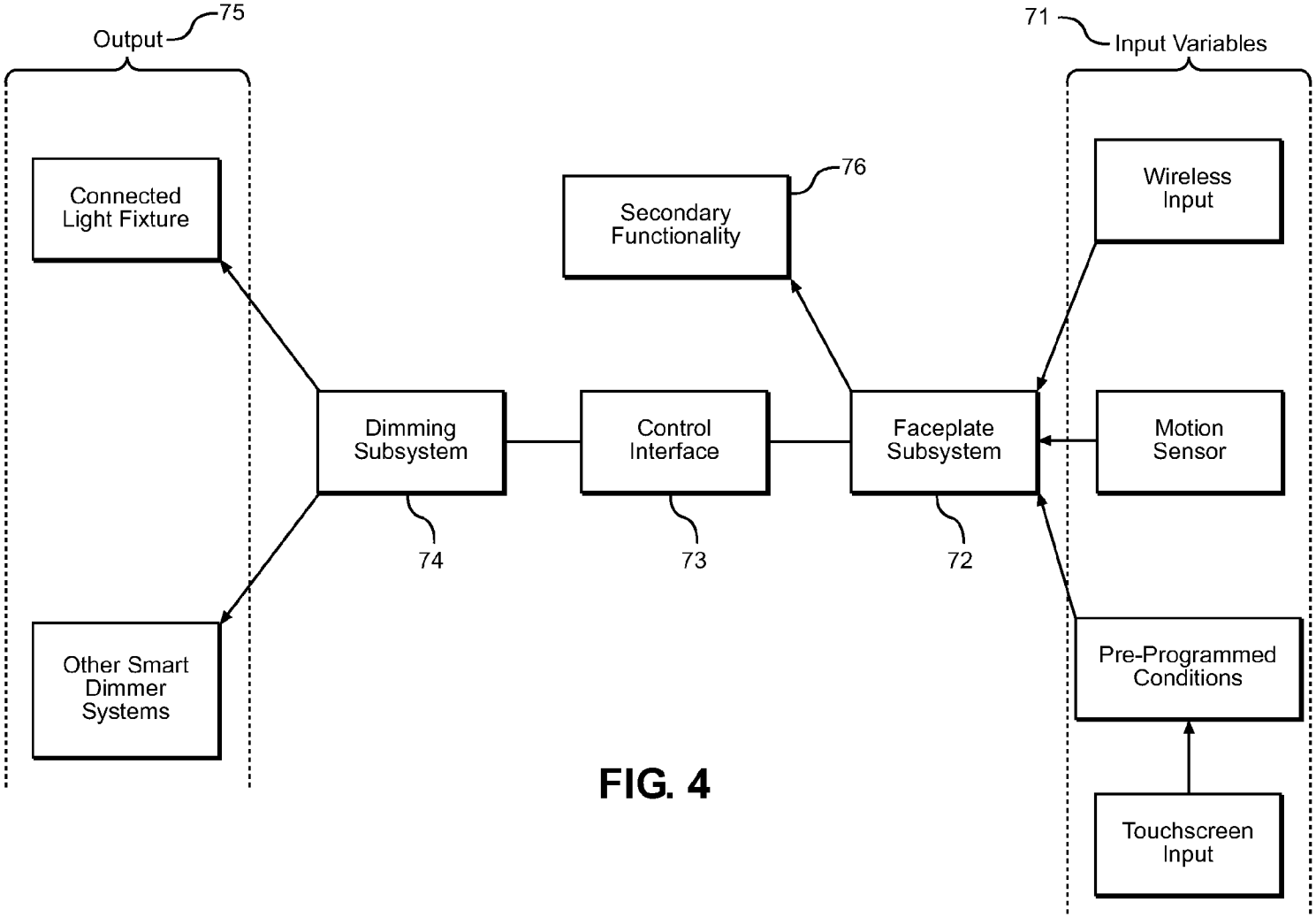
FIG. 4 shows a flowchart depicting the general function of the present invention.

Referring now to FIG. 4, there is shown a flowchart depicting the general function of the present invention. The present invention comprises two main subsystems: the faceplate 72 and the dimming subsystem 74, which are connected via the control interface 73. The faceplate subsystem 72 is housed within the faceplate and is programmed to respond a variety of different inputs 71, including input from a wirelessly connected electronic device having a user interface for transferring actuation from the user, pre-programmed conditions established by the user either through direct use of the touchscreen or that were programmed wirelessly to be executed at a later time, and a motion sensor disposed on the exterior of the faceplate in certain embodiments of the present invention. The faceplate subsystem 72 detects these variable inputs 71 and translates the relevant inputs into a signal, which is transmitted to the dimming subsystem 74 via the control interface 73. Variable inputs 71 not relevant to the dimming subsystem 74 are instead executed by the faceplate subsystem 72 itself. Such executable actions include increasing the luminosity of the faceplate itself, rather than increasing the luminosity of connected light fixtures as performed by the dimming subsystem 74, so that the device can function as a night light and displaying a stored picture as a screen-saver or an electronic picture frame when the device is not in use. In response to signals received from the faceplate subsystem 72, the dimming subsystem 74 modulates these signals using either PWM or reverse phase control generate the output 75 to control the luminosity of any light fixtures connected thereto or any other programmable touchscreen dimmers connected in series. In the preferred embodiment of the present invention, the dimming subsystem is able to selectively send the signals to selected light fixtures if multiple light fixtures or programmable touchscreen dimmers are attached thereto.

In use, an individual installs the dimmer circuitry housing within a standard electrical light switch box. The dimmer circuitry housing is connected to light sources using the same hot, neutral, and ground wires to which a conventional light switch or dimmer is attached. The dimmer circuitry housing contains a microcontroller that allows the present invention to output either a PWM or reverse phase control signal in order to effectuate the dimming of the light sources. The present invention preferably automatically detects what type of light source is connected and utilizes the ideal type of signal for that type of light source. A PWM signal substantially reduces the power consumption by the connected light source. An interchangeable faceplate is then mounted to the dimmer circuitry housing. The faceplate has a touchscreen that allows the user to input a number of different commands, preferably including the ability to program the present invention to automatically dim the attached light sources based upon a set time schedule and in response to various external variables. The touchscreen display is dynamic, allowing the user to shift between various menus and command options. Furthermore, the present invention preferably may serve as a night light or display a static image when not in use.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A programmable touchscreen dimmer, comprising:

a control housing;

a faceplate having a touchscreen, said faceplate removably affixed to said control housing;

a control interface disposed on said control housing;

said control interface connecting said control housing and said touchscreen such that said control housing and said faceplate are able to interact and share data and inputs between each other;

a dimmer subsystem alternately utilizing pulse-width modulation and reverse phase control to regulate an amount of power received by a light fixture connected to said programmable touchscreen dimmer;

said touchscreen displaying a user interface;

said user interface adapted to receive inputs from a user and thereby modulate said dimmer subsystem;

wherein said control housing is connected to a light fixture and said dimmer subsystem is adapted to control the luminosity of said light fixture.

2. The programmable touchscreen dimmer of claim 1, wherein said control housing is shaped to fit within a conventional electrical outlet box.

3. The programmable touchscreen dimmer of claim 1, further comprising:

a wireless connectivity subsystem capable of receiving wireless inputs from a user via an electronic device;

wherein said wireless connectivity subsystem relays said wireless inputs to said dimmer subsystem.

4. The programmable touchscreen dimmer of claim 1, wherein said touchscreen is adapted to display an image after a preset period of time without user input.

5. The programmable touchscreen dimmer of claim 1, wherein said dimmer subsystem can be programmed to follow a schedule set by a user.

6. The programmable touchscreen dimmer of claim 1, further comprising a motion sensor.

7. The programmable touchscreen dimmer of claim 6, wherein said touchscreen is adapted to display an image after a preset period of time without detecting movement via said motion sensor.

8. The programmable touchscreen dimmer of claim 1, wherein said user interface comprises a luminosity bar capable of receiving actuation from a user and said dimmer subsystem to alter said amount of power received by said light fixture.

9. The programmable touchscreen dimmer of claim 1, wherein said user interface further includes at least one additional means for user input.

10. The programmable touchscreen dimmer of claim 1, wherein said dimmer subsystem automatically selects between pulse-width modulation and reverse phase control to regulate an amount of power received by a light fixture connected to said programmable touchscreen dimmer.

11. The programmable touchscreen dimmer of claim 1, wherein a user is capable of selecting between pulse width modulation and reverse phase control for said dimmer subsystem utilizing said user interface.

12. The programmable touchscreen dimmer of claim 1, further comprising a memory unit for storing user uploaded images.

* * * * *